US006073315A

United States Patent [19]

Rasmussen

[11] Patent Number: 6,073,315

[45] Date of Patent: Jun. 13, 2000

[54] LOOP FASTENER

[76] Inventor: Von O. Rasmussen, 4408 Mark Ave., Las Vegas, Nev. 89108

[21] Appl. No.: 09/124,456

[22] Filed: Jul. 28, 1998

[51] Int. Cl.[7] ..... B65D 63/10

[52] U.S. Cl. ..... 24/16 PB; 24/30.5 P

[58] Field of Search ..... 24/16 R, 16 PB, 24/17 AP, 306, 30.5 R, 30.5 P, 442, 17 A; 248/74.3

[56] References Cited

U.S. PATENT DOCUMENTS

| | | | |
|---|---|---|---|
| 535,502 | 3/1895 | Knighton . | |
| 800,050 | 9/1905 | Ayres . | |
| 2,373,328 | 4/1945 | Morehouse . | |
| 3,006,048 | 10/1961 | Windish . | |
| 3,059,359 | 10/1962 | Goldammer et al. . | |
| 3,109,212 | 11/1963 | Emery . | |
| 3,144,695 | 8/1964 | Budwig . | |
| 3,501,814 | 3/1970 | Anderson et al. | 24/16 PB |
| 3,835,505 | 9/1974 | Shewbridge . | |
| 4,630,384 | 12/1986 | Breen . | |
| 5,581,850 | 12/1996 | Acker . | |

*Primary Examiner*—James R. Brittain
*Attorney, Agent, or Firm*—Quirk & Tratos

[57] ABSTRACT

A band is set forth which can function to wrap bundles of items together or to secure one item to another. In a first mode, the band is wrapped about a bundle and an opening disposed along the length of the band is passed over a stud to secure the band wrapped about the bundle. In the second mode, the band is wrapped about one item and an end is passed through a slit near the other end of the band to define a first loop. The band is thereafter wrapped about the other item to define a second loop and an opening is passed over the stud to secure the band.

4 Claims, 2 Drawing Sheets

16
20
18
32
30
34
12
36
10
38
40
38
24b
24a
22
26
14

16
12
10
38
38
26
52
28
29
14

10
28
46
46
44
42
50
46
12
48

LOOP FASTENER

FIELD OF THE INVENTION

The present invention relates to loop fasteners and straps adapted to secure and bundle cables, line and the like as well as rolled up items such as hoses.

BACKGROUND OF THE INVENTION

Loop-type fasteners have been known in the prior art. For example in Acker, U.S. Pat. No. 5,581,850 issued Dec. 10, 1996, the disclosure of which is incorporated by reference, a fastening device is shown adapted to secure bundles of cables and cord. This fastener is embodied as an elongate strip having proximate one end a pair of slots in the body and along the length a series of notches and angular shoulders. The angular shoulders extend inwardly from the margins of the strap narrowing the lateral dimension of the strap body and defining lines of weakness which can rupture destroying the utility of the strap. Furthermore, the fastening technique used in these type of straps subjects them to disengaging the angular shoulder from the slot and unbundling the items. For example, should the tongue of this type of fastener be rotated ninety degrees as by bumping or rubbing, the shoulders will disengage from the slot unbundling the cables. This also detracts from the utility of the strap.

There is a need for a fastener or band which overcomes the drawbacks of fasteners of the type described above.

There is also a need for a band which minimizes the points of weakness in the band extending the useful life thereof.

There is a need for a band which can both function to bundle other items to another such as a main power cord and which can also function to wrap bundle items together.

There is also a need for a band which positively engages the ends thereof to secure the bundle against inadvertent release.

There is also a need for an elastic band, the elasticity of which can be relied on to securely snug the bundle as fastened by the band.

SUMMARY OF THE INVENTION

There is, therefore, set forth according to the present invention, a band for securing a first and a second item together, those items may be a base cord, such as a power cord with second item being a bundle of cables such as computer data cables. The band includes an elongate body having a first and second end and uninterrupted, substantially parallel side margins. A slit is provided proximate the first end and is adapted to pass the second end there through to form a first loop for securing the body about the first item such as the power cord for a computer. A stud is disposed at the first end. The body includes a plurality of spaced openings there along each adapted to pass the stud when the body is formed into a second loop about the second item, e.g., a cable bundle, to secure the items together.

In a further embodiment, the band may include one or more notches formed in the side margins proximate the first end which are adapted to register into the slit to secure the first loop.

In still a further embodiment, the band may be elastic so that it may be extended to snugly secure the items together and exert a modicum of capture bias on the second item to the first item.

In still a further embodiment, the slit is provided with bores at the ends to receive the notches and provide a degree of adjustment of the size of the first loop.

The band according to the present invention does not include numerous marginal shoulders defining lines of weakness in the band but instead includes spaced openings which are adapted to be passed over the stud to positively secure the band about the second item against inadvertent release. Furthermore, by providing the band with elasticity, the capture of the first item to the second item may be enhanced by the exertion of a bias. Still further the band can operate in a first configuration to wrap bundle items or in a second configuration to secure one item to another.

BRIEF DESCRIPTION OF THE DRAWINGS

These and other features and advantages will become appreciated as the same becomes better understood with reference to the specification, claims and drawings wherein:

FIG. 5 a side view showing the band used in a configuration to wrap bundle items such as, cords and the like.

DESCRIPTION

Figures 1, 2, 3:
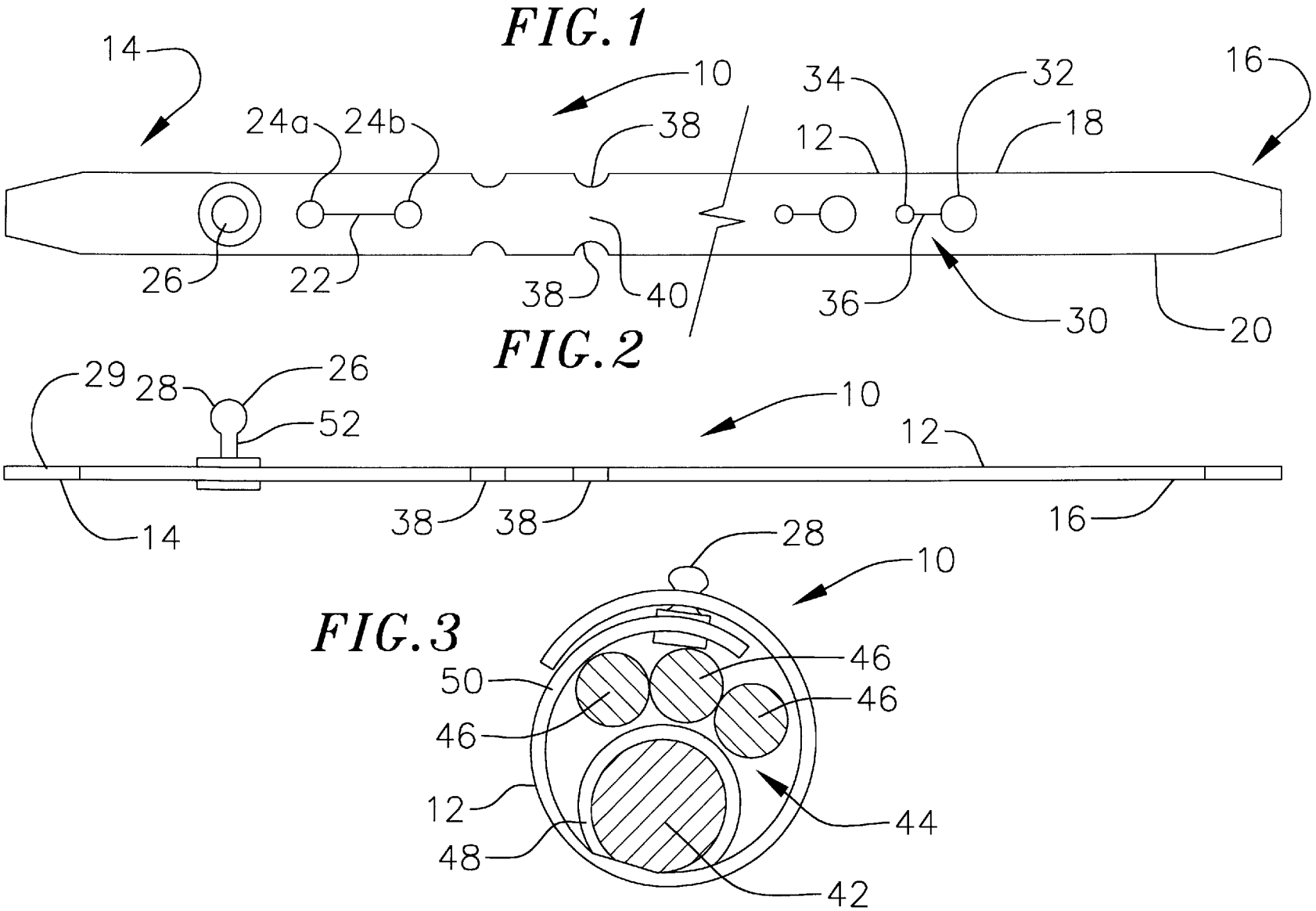
FIG. 1 is a top plan view of the band according to the present invention.
FIG. 2 is a side view of the band according to the present invention.
FIG. 3 is an illustration of the band as used to secure one item to at least another plurality of items such as by bundling cables.

Turning to the drawings, FIG. 1 shows a band 10 according to the present invention. The band 10 has a body 12 having a first end 14 and a second end 16. As can be appreciated with reference to FIGS. 1 and 2, the body 12 is preferably elongate in the form of a strap having substantially uninterrupted, parallel side margins 18,20. The body 12 is preferably fashioned from an elastic material such as rubber, elastic or the like.

Proximate the first end 14, the body 12 includes a slit 22 which preferably extends between a pair of end bores 24*a,b* adapted to reduce the stresses on the body 12 as the slit 22 is expanded and contracted during use of the band 10 and prevent migration of the slit 22 along the body 12. As described below, the bores 24*a,b* also provide for a degree of adjustment of the band 10.

With continuing reference to FIGS. 1 and 2, a stud 26 is disposed at the first end 14, the stud 26 including an enlarged, preferably rounded, head 28. The Stud 26 is spaced from the terminus of the first end 14 to provide a tab 29 to accommodate the manipulation of the band 10 first end 14 as hereinafter described.

Remote from the first end 14, the body 12 includes a plurality of spaced openings 30 fashioned therein. As illustrated in FIG. 1, each of the openings 30 may include an enlarged first bore 32 and a smaller second bore 34 having a cut 36 there between. By providing the first and second bores 32, 34, the stresses at the margins of the openings 30, as they are expanded and contracted to pass the head 28 of the stud 26 in the manner described below, are reduced. The first and second bores 32, 34 prevent the cut 36 from migrating along the body 12 and damaging the band 10.

As shown, the body 12 may include a plurality of openings 30 spaced there along. Also as suggested in FIG. 1, the body 12 may be of any desired length, width or thickness.

Proximate the first end 14 and disposed at the other side of the slit 22 from the stud 26 is at least one and preferably a pair of arcuate notches formed in the side margins 18, 20 of the body 12. As shown, the notches 38 of each pair are laterally aligned to define there between a neck 40. The rounded nature of the notches 38 again reduces the stresses on the body 12 to prevent cracking and tearing.

Figure 4:
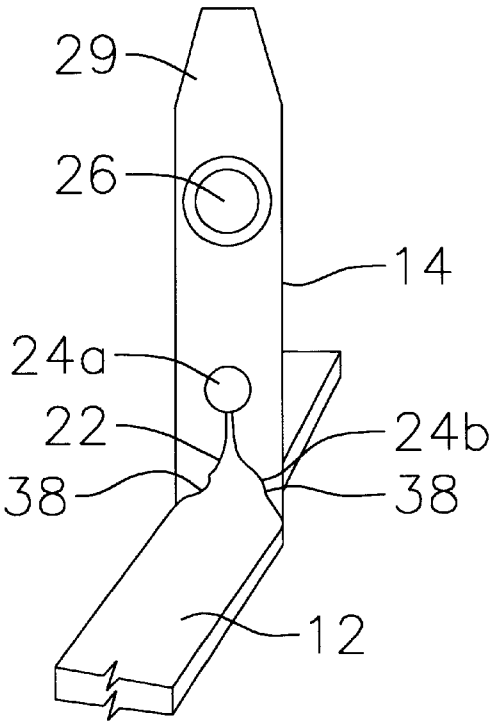
FIG. 4 is a perspective view of a portion of the band showing an adjustment feature of the band.

With reference to FIG. 3, the operation of the band 10 will now be described. The band 10 is used to secure first and second items illustrated as, for example, a first cable 42 with the second item being a bundle 44 of wires 46. The first cable 42 may be a power cord whereas the wires 46 may comprise data, telephone and other wires used, for example, in a computer system. Alternatively the first item could be a drill power cord and the second item the chuck key for the drill. While the description is directed to securing cords and cord bundles it is to understood that the two items to be connected could be any suitable objects. As illustrated, with reference to FIGS. 1, 3 and 4 the band 10 is first wrapped about the first cable 42 and the second end 16 is passed through the slit 22. The slit 22 expands to accommodate the second end 16. The second end 16 is drawn through the slit 22 to tighten the body 12 about the first cable 42 preferably to a position where at one of the pair of notches 38 registers within one of the end bore 24*a,b* to secure the band 10 about the first cable 42 and define a first loop 48. The spacing of the end bores 24*a,b* provides for a degree of adjustment of the size of the first loop 48 since the notches 38 can register within either of the end bores 24*a,b*. Thereafter the second end 16 is wrapped about the bundle 44 defining a second loop 50 to locate one of the openings 30 at the stud 26. Pressing downwardly on the body 12 urges the opening 30 to open to pass the head 28 of the stud 26. After passing the head 28, the margins of the opening 30 collapse upon the post 52 for the stud 26 positively securing the second loop 50 about the bundle 44. As can be appreciated, the positive engagement between the opening 30 over the stud 26 prevents inadvertent release of the second end 16 from the stud 26.

As stated above, preferably the body 12 is made from an elastic material. Accordingly, when fashioning either the first or second loop 48,50, the body 12 may be stretched or pulled to tighten the first loop 48 about the first cable 42 and the bundle 44 against the first loop 48 and exert a constricting bias thereupon to securely bind the bundle 44 to the first cable 42.

Figure 5:
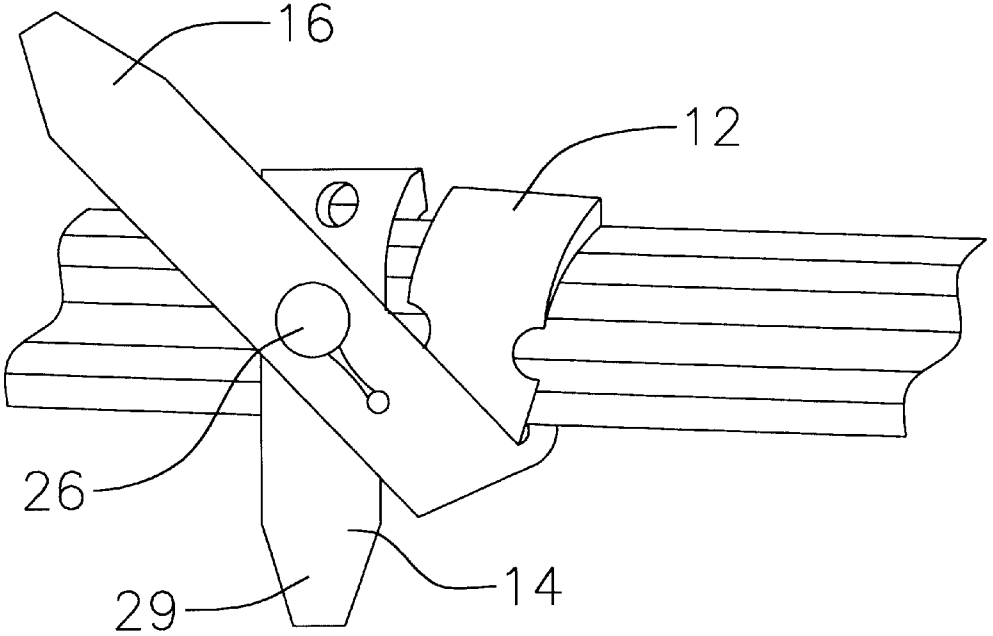

With reference to FIG. 5, the band 10 is shown operating in another configuration as a strap for wrapping a bundle of items, such as cords, together. The first end 14 is held against the bundle by, for example, the tab 29, and the body 12 is wrapped about the bundle. An opening 30 is positioned over the stud 26 and the body 12 is pressed downwardly to urge the stud head 28 to pass there through to secure the wrapped band 10 about the bundle.

Thus it can be appreciated that the band 10 can operate in either one mode to wrap bundles of items such as cords, garden hoses, rope or the like and can be used in a second mode to secure items together by fashioning the first and second loops 48,50.

It can further be understood that the band 10 can be configured by using a longer stud 26 or a thinner body 12 to be wrapped multiple times and passed over the stud 26 several times. Thus even should one turn of the band 10 disengage the stud 26, the other turn secured over the stud 26 will hold the bundle or items together. According to this embodiment, one turn is secured over the stud 26 in the manner described above. The body 12 is wrapped again about the bundle, for example, and the body 12 is again secured to the stud 26 in a like manner.

While I have shown and described certain embodiments of the present invention, it is to be understood that it is to be subject to may modifications and changes without departing from the spirit and scope of the appended claims.

I claim:

1. A band for securing a first and a second item together comprising:

a body having a longitudinal dimension with a first end and a second end and side margins;

a slit proximate the first end adapted to pass the second end there through to form a first loop for securing the body about the first item;

proximate the second end at least one pair of notches disposed at the margins at either side of the band adapted to, when the second end is passed through the slit register the notches into the bounds of the slit to secure the body to the first end at the slit and prevent withdraw thereof from the slit and to define said first loop, the slit further including end bores at the ends of the slit each having a diameter comparable to the lateral spacing between the notches, each end bore adapted to register a notch pair;

a stud disposed at the first end; and said body including a plurality of spaced openings there along each adapted to capture the stud when the body is formed into a second loop about the second item to secure the items together.

2. The band of claim 1 including a plurality of notch pairs to fashion a plurality of different size first loops.

3. A band for securing a first item to a second item comprising:

a longitudinally extending elastic body having a first end and a second end and parallel, side margins, said body including a pair of notches at opposite side margins of the body;

a slit in the body proximate the first end having bores at the ends thereof, said slit adapted to expand to pass the second end there through to fashion a first loop about said first item, each end bore having a diameter comparable to the lateral spacing between the notches of a notch pair to secure the notches withing a slit bore;

a stud disposed at the first end; and a plurality of openings spaced along the body between said notches and said second end each adapted to pass the stud to secure the body to the stud to define a second loop about the second item.

4. A band adapted to, in a first configuration, wrap bundle items together and in a second configuration form two loops to secure one item to another comprising:

an elastic body having a first end and a second end and substantially parallel, side margins;

a stud disposed at the first end;

a plurality of openings spaced along the body, each adapted to pass the stud to secure the body in said first configuration;

a slit in the body proximate the first end having end bores said slit adapted, in said second configuration, to expand to pass the second end there through to fashion a first loop about said one item; and said body including a pair of notches at opposite side margins of the body adapted to register in and be captured by the slit end bores to secure the first loop about the one item, said body adapted to form a second loop about said other item to locate one of said openings for engagement with the stud to secure said second loop.

* * * * *